United States Patent [19]

Olesen

[11] Patent Number: 4,913,332

[45] Date of Patent: Apr. 3, 1990

[54] SHEATH RELEASE DEVICE FOR STAPLER

[75] Inventor: Paul Olesen, Bellmore, N.Y.

[73] Assignee: Swingline Inc., Long Island City, N.Y.

[21] Appl. No.: 300,511

[22] Filed: Jan. 23, 1989

[51] Int. Cl.[4] ..... B27F 7/11

[52] U.S. Cl. ..... 227/123; 227/131

[58] Field of Search ..... 227/120, 123, 131

[56] References Cited

U.S. PATENT DOCUMENTS 4,200,215 4/1980 Novak et al. ..... 227/123
4,520,956 6/1985 Urrestt ..... 227/123 X
4,570,841 2/1986 Olesen ..... 227/131 X
4,641,772 2/1987 Skuthan ..... 227/123

*Primary Examiner*—Paul A. Bell
*Attorney, Agent, or Firm*—Pennie & Edmonds

[57] ABSTRACT

A mechanism for releasing for unjamming purposes the sheath positioned adjacent and urged against a stapler housing by a spring. The sheath includes round apertures having rotatable members mounted therein with the rotatable members carrying the spring offset so that when the rotatable members are rotated through crank means the spring is urged in a direction to move the sheath to a position to facilitate unjamming the stapler.

4 Claims, 7 Drawing Sheets

SHEATH RELEASE DEVICE FOR STAPLER

Background of the Invention

Staplers have been provided with sheaths positioned spaced-apart from the staple head base member with the space between the base member and the sheath providing a channel for movement of staple blanks as stripped from staple blank ribbons or sticks during transport, forming, driving, and clinching. Sheaths have been spaced apart using spacer lugs on the base member and a spring arrangement to urge the sheath against the spacer lugs (U.S. Pat. No. 4,570,841).

Summary of the Invention

Broadly, the present invention comprises a sheath release means for unjamming a stapler comprising a mounting member capable of rotation in an opening in the sheath, a spring clamp member which during normal operation urges the sheath against the housing connected to the periphery of the rotatable mounting member crank means connected to the rotation member to partially rotate the member to move the spring member away from the housing.

It is a feature that the crank means may also function as the spring harness for holding the staple cartridge in position.

Description of the Preferred Embodiment

Figure 1:
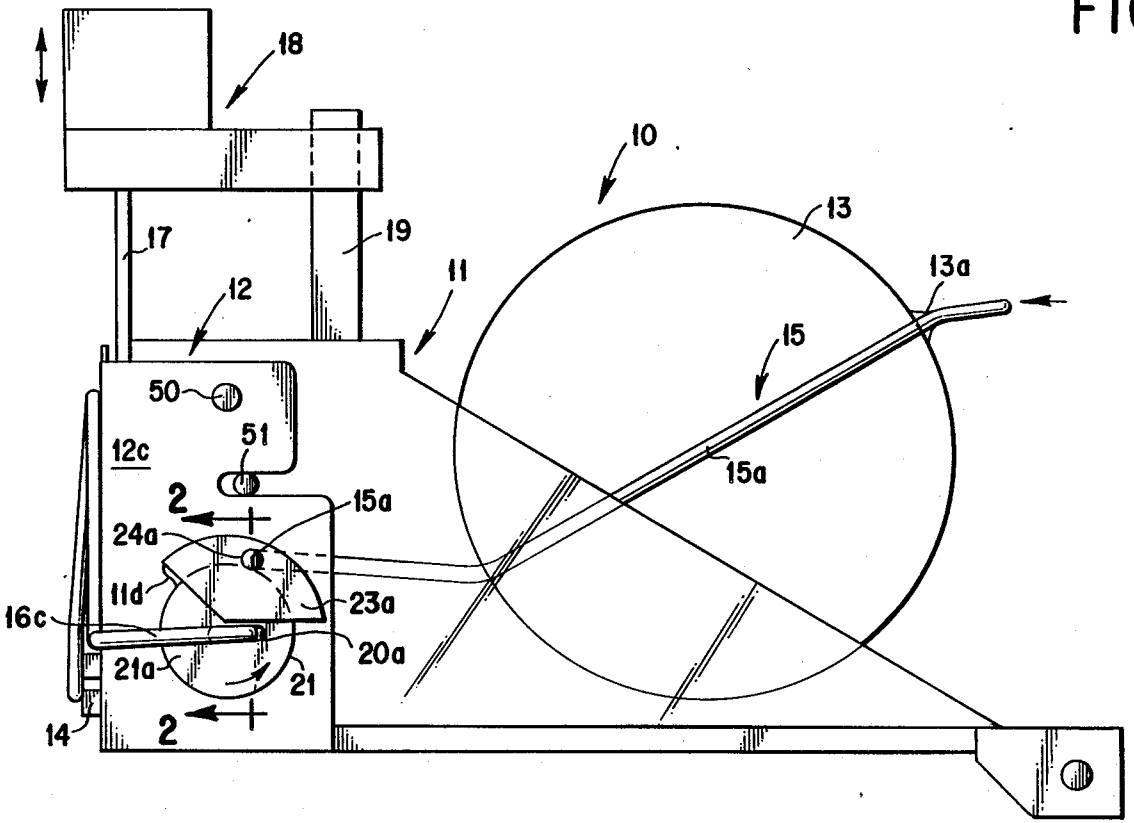
FIG. 1 is a side elevational view of a stapler of the present invention with the spring retainer member engaging both the cartridge and the rotation element.
Figure 2:
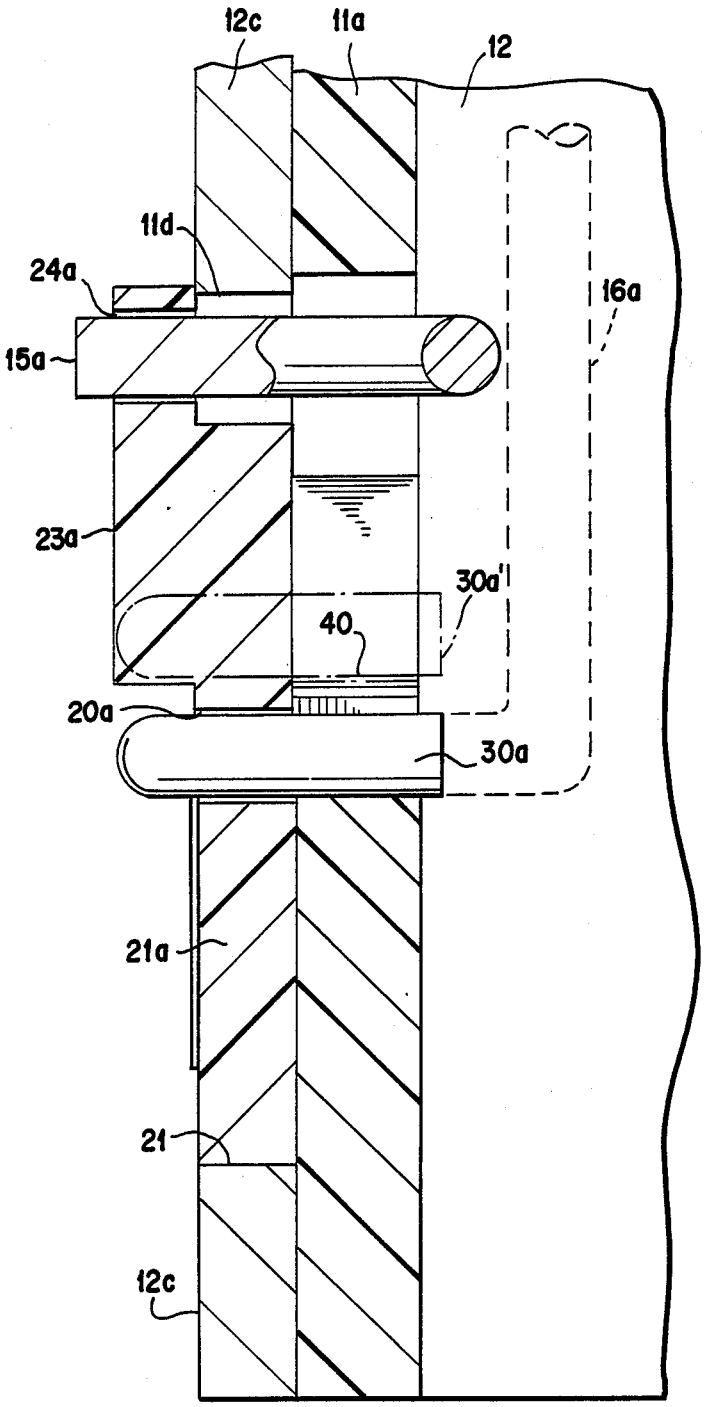
FIG. 2 is an enlarged sectional view along line 2—2 of FIG. 1.
Figure 3:
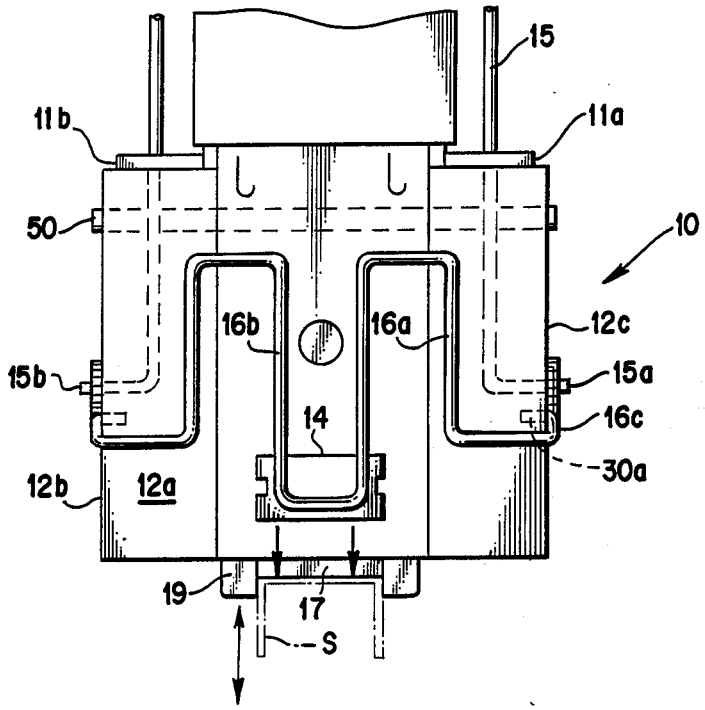
FIG. 3 is a front partial elevational view of a stapler of the present invention in the process of driving a formed stapler.

In FIGS. 1-3, stapler 10 includes a U-shaped housing 11, a generally U-shaped sheath 12 consisting of front sheath panel **12*a*, left panel 12*b* and right panel 12*c* (each at right angle to the front panel 12*a*), a cartridge 13 for delivering staple blanks to former block 14. Cartridge 13 is held in place by cartridge clamp spring 15 which snaps into cartridge groove 13*a*. Sheath and anvil spring 16 including spring loops 16*a* and 16*b*, spring side arms 16*c* and 16*d*, and rotation bars 30*a*, 30*b* urges forming block 14 against sheath 12 which in turn is urged against spacer lugs (not shown) on housing 11. Also shown are staple S, driver 17, reciprocal former 19 which carries guide driver 17** as it reciprocates.

Housing 11 includes sides **11*a* and 11*b* each of which carries a round aperture 21, 22 respectively. Each aperture 21, 22 has mounted in it for rotation therein a disk 21*a*, 22a preferably made of plastic. Positioned on the upper portion of each disk 21*a*, 21*b* is a pie-shaped segment 23*a*, 23*b* also preferably made of plastic. Each segment 21*a*, 23*b* has a hole 24*a*, 24*b* in it for receiving cartridge retainer spring horizontal projection portion 15*a*, 15*b***.

Turning in particular to FIG. 1, sheath panel **12*c*, preferably made of metal, carries sheath slot 11*d* in which spring arm 15*a* rides as it protrudes through hole 24*a* in segment 23*a*. Also shown is disk 21*a* and disk slot 21*a* and cartridge spring crank 15**.

Figure 5:
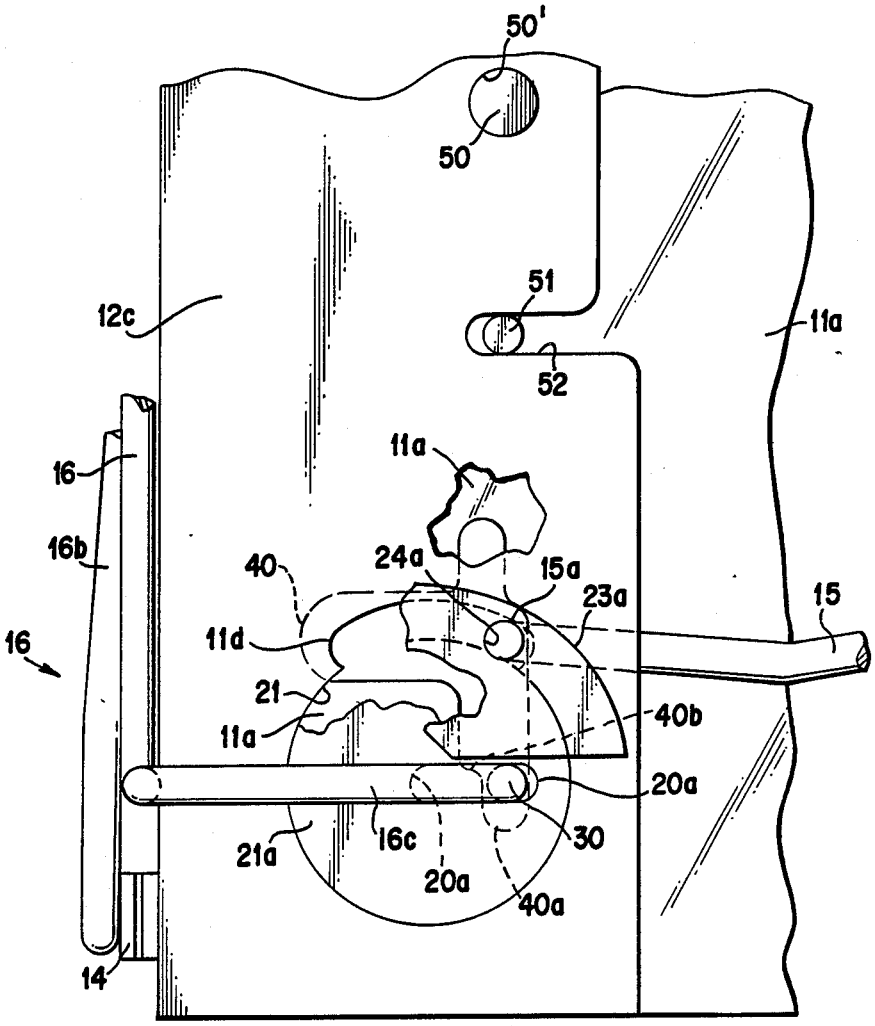
FIG. 5 is an enlarged partial side view of the stapler including forming anvil, spring clamp and rotation member in their first tensioned position.

Looking now at FIG. 5, housing side **11*a* has configured recess 40 shown partially in dashed lines. Recess 40 has lower recess portion 40*a* to accommodate spring crossbar 30*a* in its normal tensioned operating position and recess portion 40*b* to which bar 30 is rotated when spring clamp 15, serving as a crank, is used to rotated segment 23*a* and disk 21*a* which rotate as a unit. Housing side 11*b*** has a similar configured recess (not shown).

FIG. 2 shows pie-shaped segment **23*a*, segment hole 24*a*, spring arm 15*a* in hole 24*a* and further illustrates that spring crossbar 30*a* is moved upwardly to a position 30*a*' shown in solid and dashed lines when segment 23*a* and disk 21*a* are rotated. Also shown are aperture 21, right panel 12*c* and slot 11*d* in sheath panel 12*c*. Spring bar 30*b*** (not shown) is similarly activated.

During normal operation of stapler 10, cartridge 13 is held in position as cartridge spring 15 is snapped into groove **13*a* with spring arms 15*a*, 15*b* pulling segments 23*a*, 23*b* to the right as shown in FIG. 1, thus tending to rotate disks 21*a*, 21*b* clockwise. Spring clamp 16 is held firmly in operational position in recess portions 40*a* (FIG. 5). Disks 21*a*, 21*b* are positioned with their slots 20*a*, 20*b***in generally horizontal position (see FIGS. 1 and 5).

Figure 4:
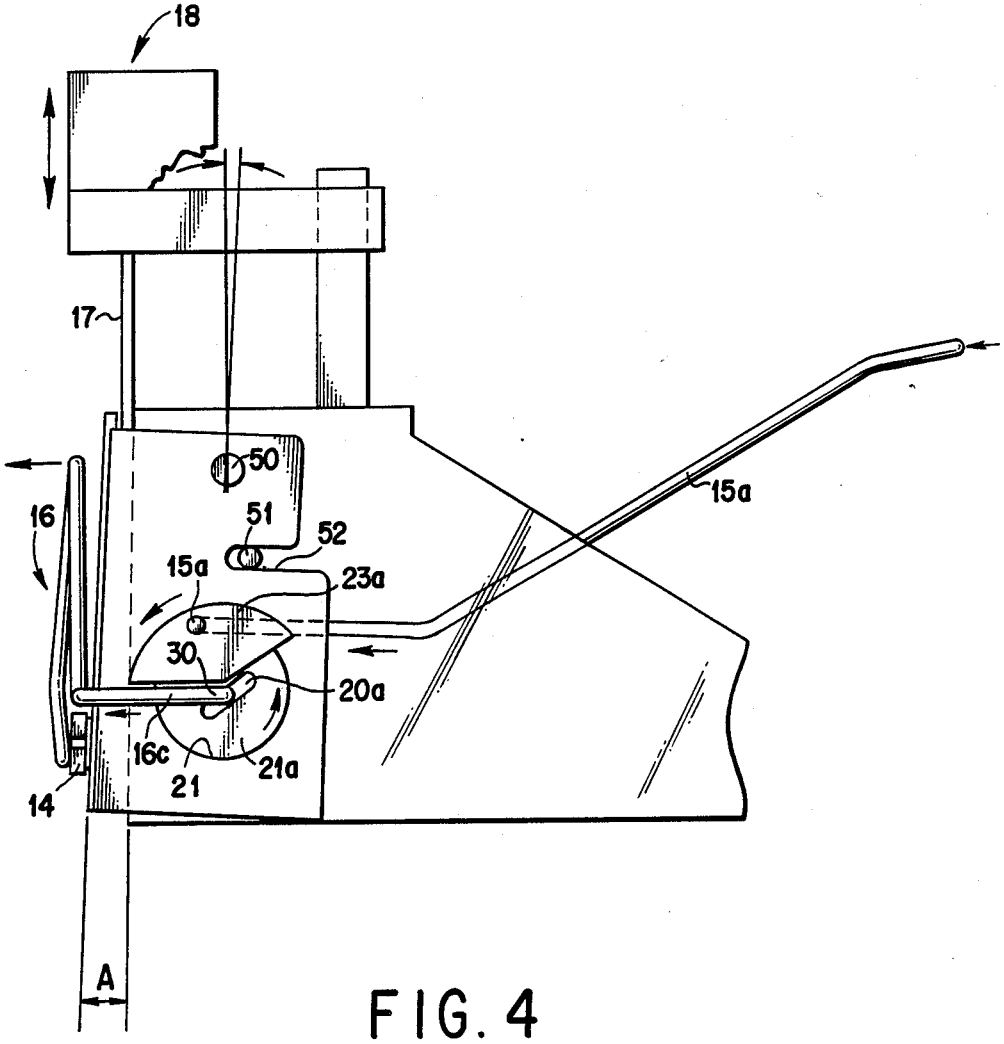
FIG. 4 is a side elevational view of the stapler with the cartridge spring retainer member freed from the cartridge and moved to the left to rotate the rotation member.
Figure 5A:
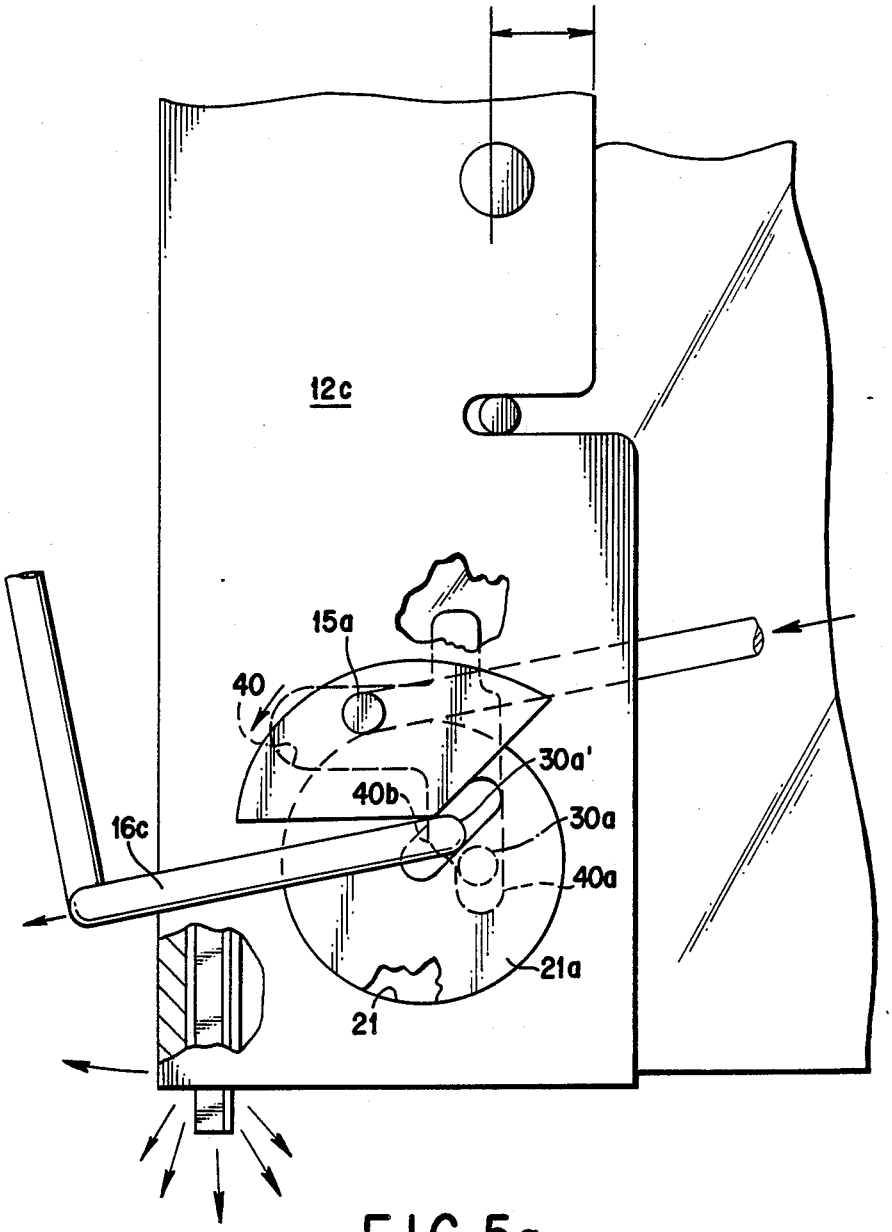
FIG. 5*a* is a view similar to FIG. 5 with the assemblage released.
Figure 6:
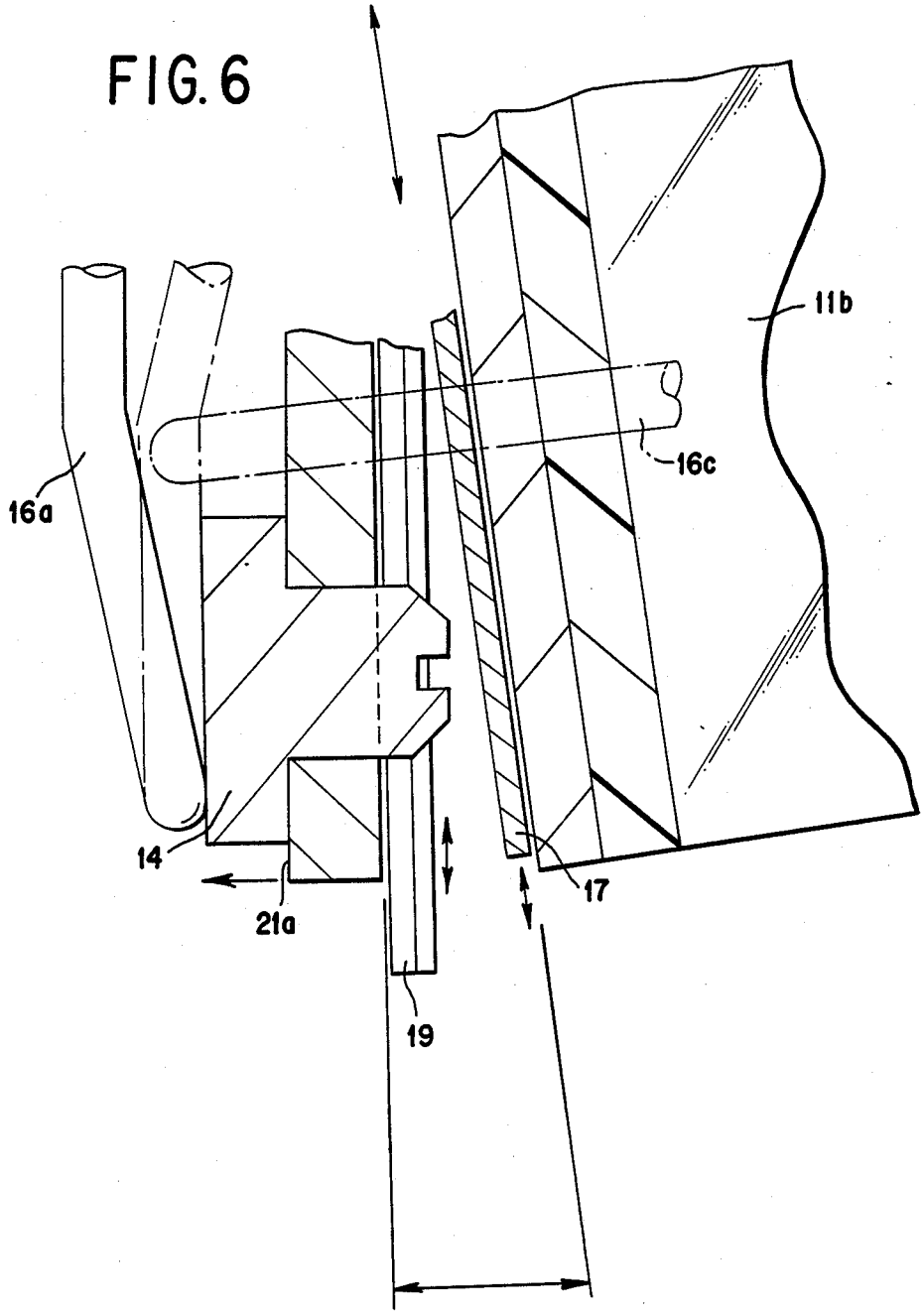
FIG.6 is an enlarged partial elevational view of the sheath and spring clamp as released.

If a jam occurs such as a staple bending and failing to discharge into the workpiece and thus release of the sheath 12 or forming block 14 or both becomes necessary, cartridge spring 15 is snapped out of groove **13*a* releasing cartridge 13. Cartridge spring 15, now free, is urged to the left in FIGS. 1 and 4 to crank or rotate segments 23*a* (and 23*b* not shown), and attached disks 21*a* (and 21*b* not shown) causing spring 16 to move left as spring crossbars 30*a*, 30*b* move upwardly urged by slots 20*a*, 20*b*** movement (FIGS. 4 and 5*a*). Spring arm **15*a* moves in recess 40 and arm 15*b* moves in its corresponding recess not shown. Movement continues until spring bars 30*a*, 30*b* snap into recess portions 40*b*, one in each housing side 11*a*, 11*b*. As spring crossbars 30*a*, 30*b* (which are integral parts of spring clamp 16) move, sheath 12 swings about pivot pin 50 (see FIGS. 1 and 6) through an arc equal to angle A (FIG. 4). The pressure on forming block 14 is also reduced. As block 14** moves further left, jammed staples S can be removed.

I claim:

1. In a stapler having a U-shaped housing, a generally U-shaped sheath including side panels and an anvil, both being urged against the housing by a clamp spring having crossbars, and a cartridge, an anvil, and control means for normally positioning the spring to urge the anvil and sheath toward the housing and for releasing the spring comprising a. a round aperture in each sheath side panel;

b. a rotatable member mounted in each aperture;

c. slot openings in the rotatable member for receiving the clamp spring crossbars;

d. configured recesses in the housing for accommodating and engaging the crossbars;

e. crank means attached to the rotatable members for causing the rotatable members to rotate to move the crossbars in such recesses to in turn move the remainder of the clamp spring toward and away from the sheath; whereby the anvil and sheath may be moved away from the stapler housing to assist in alleviating a staple jam.

2. The stapler of claim 1 in which the recesses in the housing each include a first recess portion which engages the crossbars during normal operation and a second recess position into which such crossbars are moved upon rotation of the disks.

3. The stapler of claim 1 in which the rotatable member is held in the round aperture between the side arms of the spring and the housing.

4. The staple of claim 1 in which the sheath is pivotally mounted on the housing.

* * * * *